US005078210A

United States Patent [19]

George

[11] Patent Number: 5,078,210

[45] Date of Patent: Jan. 7, 1992

[54] TIME DELAY PERFORATING APPARATUS

[75] Inventor: Kevin R. George, Columbus, Tex.

[73] Assignee: Halliburton Company, Duncan, Okla.

[21] Appl. No.: 616,662

[22] Filed: Nov. 21, 1990

Related U.S. Application Data

[63] Continuation of Ser. No. 404,029, Sep. 6, 1989, abandoned.

[51] Int. Cl.[5] ..... E21B 43/1185

[52] U.S. Cl. ..... 166/55; 175/4.54

[58] Field of Search ..... 166/55, 297; 175/4.54, 175/4.56

[56] References Cited

U.S. PATENT DOCUMENTS

| | | | |
|---|---|---|---|
| 3,011,551 | 12/1961 | Young et al. | 166/55.1 |
| 3,189,094 | 6/1965 | Hyde | 166/55.1 |
| 3,706,344 | 12/1972 | Vann | 166/297 |
| 4,478,294 | 10/1984 | Sumner | 175/4.56 |
| 4,614,156 | 9/1986 | Colle, Jr. et al. | 102/312 |
| 4,619,333 | 10/1986 | George | 175/4.52 |
| 4,690,227 | 9/1987 | George et al. | 175/4.56 |

OTHER PUBLICATIONS

Exhibit A-Drawing.

Vann Systems Engineered Well Completion Product Catalog, pp. A-5-A-7; B1-B3; and B-3; and TCP 1001; TCP 1013; TCP 1022; TCP 1014; TCP 1016; TCP 1020; TCP 1018; and TCP 1024.

*Primary Examiner*—William P. Neuder

*Attorney, Agent, or Firm*—James R. Duzan; Neal R. Kennedy

[57] ABSTRACT

A time delay perforating apparatus and method of use. The apparatus includes at least one first and second gun with a time delay device positioned therebetween. The time delay device delays firing of the second gun for a predetermined period after firing of the first gun and prevents fluid communication between the first and second guns. The time delay device is positioned in a housing interconnecting the first and second guns and closes off a central opening through the housing. The time delay device includes a body with a primer assembly, a firing pin for detonating the primer assembly, an ignition mix ignited by detonation of the primer assembly, a time delay mix triggered by ignition of the ignition mix, and an explosive disposed in the body. The firing pin is oriented such that it closes off a central opening through the body. The explosive includes a primary explosive triggered by the time delay mix and a secondary explosive triggered by the primary explosive. The time delay device directs its explosive output to fire the second gun.

15 Claims, 2 Drawing Sheets

TIME DELAY PERFORATING APPARATUS

This is a continuation of Ser. No. 404,029, filed Sept. 6, 1989.

BACKGROUND OF THE INVENTION

1. Field Of The Invention

This invention relates to apparatus for perforating a well bore, and more particularly, to an apparatus for firing at least two guns with a predetermined time delay in between and preventing fluid flow between the guns.

2. Description Of The Prior Art

In well bore perforating operations, it is important for the operator to know whether or not all of the guns have been fired. Typically, a time delay device is positioned at the bottom of the string below the lowermost guns. The explosive output of one gun fires the next lower gun, and this continues with the lowermost gun triggering the time delay device. The time delay device has a relatively slow burning material in it, and after this material burns, a small explosive charge in the time delay device is detonated.

At the surface, the operator can hear and feel the guns firing, and after the guns cease firing, the operator listens for the detonation of the time delay device. If he hears it, he knows all of the guns have fired since the time delay device cannot be actuated otherwise.

A problem with this prior apparatus is that depending upon the depth and conditions of the well, the ignition of the small charge in the time delay device may not be heard. If this is the case, then the operator does not know if the last gun has fired.

In U.S. Pat. No. 4,478,294 to Sumner, assigned to the assignee of the present invention, a time delay is positioned above the lower one or two guns in the string. The firing of the last gun is thus delayed. The firing of the last gun is significantly louder, and thus more easily discerned, than the detonation of the small charge in the prior art time delay device because the charge in the perforating guns is considerably larger. Electrical sensors may also be provided to monitor the firing of the guns.

The apparatus of the present invention also uses a time delay device between upper perforating guns and at least the lowermost perforating gun. The time delay apparatus includes a housing positioned between the guns with a separate, easily replaceable, time delay device positioned in the housing.

Another problem with previous perforating tools is that once some of the guns have fired, fluid is free to enter all of the guns therebelow. If all of the guns do not fire, the fluid in the lower guns makes retrieval more difficult. Also, the entire tool must be broken down and drained in order to reuse the lower guns.

In the present invention, the time delay device prevents fluid communication between the upper guns and the gun or guns below the time delay device. This allows the time delay device and the guns therebelow to be rerun by simply replacing the portions of the perforating string thereabove. It is not necessary to break down the apparatus and drain it. In fact, the apparatus of the present invention could be run in multiple positions in perforating string with each location acting as a fluid isolation device to prevent fluid entry into the lower guns in the event of a "stop-fire" (misfire).

Prior art systems have included fluid isolation shims which perform this function, but the shims are not compatible with all of the firing devices and therefore are not usable in all situations. The present invention does not have this problem.

SUMMARY OF THE INVENTION

The present invention includes a downhole tool for perforating a well bore comprising a first perforating gun, a second perforating gun longitudinally spaced from the first perforating gun, and a time delay apparatus for delaying firing of the second perforating gun for a predetermined period of time after firing of the first perforating gun. The time delay device is positioned between the first and second guns such that fluid communication between the guns is prevented. One or more first guns may be used, and in the event of incomplete firing, any fluid entering the first gun or guns does not enter the second gun or guns. The first perforating gun may be either above or below the second perforating gun.

The time delay apparatus comprises housing means for connecting to the first and second perforating guns and time delay means in the housing means for the actual delaying of the firing of the second gun. The time delay means is characterized in the preferred embodiment by a time delay device disposed in the housing means. The housing means defines a housing central opening therethrough, and the apparatus further comprises sealing means for sealing between the time delay means and the housing central opening.

The time delay device comprises a primer assembly, firing means, such as a firing pin, for impacting and thereby detonating the primer assembly, a time delay mix triggered by detonation of the primer assembly, and explosive means for providing an explosive force which is triggered by the time delay mix. Preferably, an ignition mix is used between the primer assembly and time delay mix. All of these components are positioned in a body central opening defined in a time delay body. The explosive means is preferably characterized by a primary explosive ignitable by the delay mix and a secondary explosive ignitable by the primary explosive.

An upper retainer is engaged with the body for at least partially closing an upper end of the body central opening, and a lower retainer is provided for at least partially closing a lower end of the body central opening. A screen may be disposed between the primer assembly and the delay mix. The firing pin is shearably positioned in the body and has a shearable flange which engages a shoulder in the body. Preferably, a sealing means is provided for sealing between the firing pin and the body central opening.

An important object of the invention is to provide a well perforating apparatus by which a well operator has a positive indication that all perforating guns in the tool string have fired.

Another object of the invention is to provide a downhole tool for perforating a well bore having first and second guns with a time delay for delaying firing of the second gun for a predetermined period of time after firing of the first gun, the time delay being positioned between the first and second guns such that fluid communication therebetween is prevented.

An additional object of the invention is to provide an apparatus for perforating a well bore in which a housing is disposed between upper and lower guns with a time delay device positioned in the housing for delaying firing of one of said upper and lower guns for a predetermined period of time after firing of the other of said upper and lower guns.

A further object of the invention is to provide a time delay apparatus having a body defining a body central opening therethrough and firing means disposed across the body central opening for preventing fluid flow therethrough.

Still another object of the invention is to provide a time delay apparatus having a primary explosive ignitable by a time delay mix and a secondary explosive ignitable by the primary explosive.

Additional objects and advantages of the invention will become apparent as the following detailed description of the invention is read in conjunction with the drawings which illustrate such preferred embodiment.

DESCRIPTION OF THE PREFERRED EMBODIMENT

Figure 1:
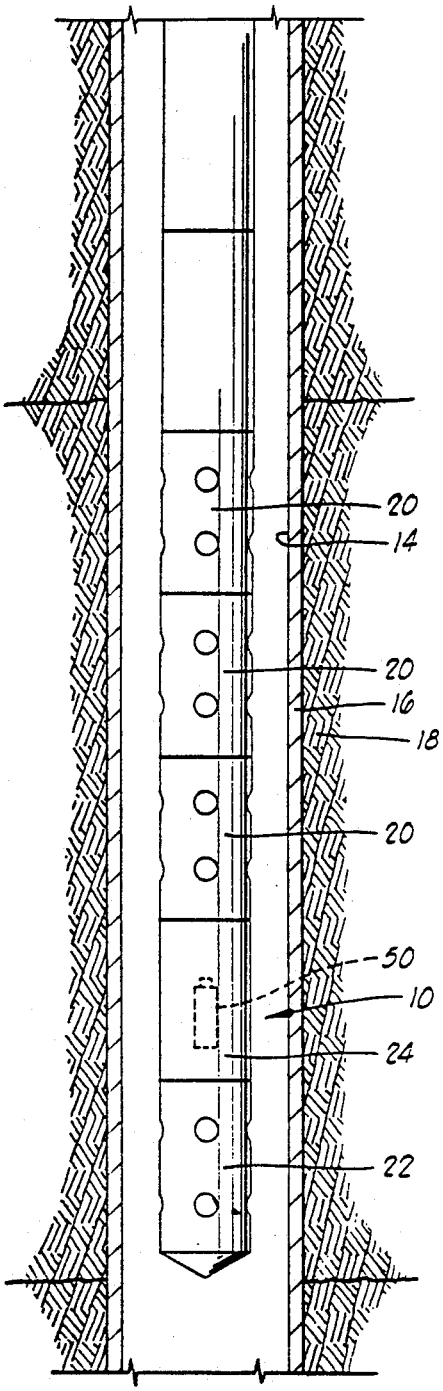
FIG. 1 illustrates the time delay perforating apparatus of the present invention in position in a well bore at the end of a tool string.

Referring now to the drawings, and more particularly to FIG. 1, the time delay perforating apparatus of the present invention is shown and generally designated by the numeral 10. Apparatus 10 is connected to the lower end of a tool string 12 and is positioned in a well bore 14 which may or may not have a casing 16. Apparatus 10 is positioned adjacent to a formation 18 to be perforated.

Apparatus 10 includes at least one first or upper gun 20 and at least one second or lower gun 22. In the preferred embodiment, there will be a plurality of upper guns 20 and a relatively fewer number of lower guns 22. The invention requires at least one lower gun, but more may be used. While guns 20 have been referred to as upper guns, and guns 22 have been referred to as lower guns, it will be understood by those skilled in the art that the guns could be reversed. That is, the firing sequence could be from bottom to top with the uppermost gun being fired after the time delay, rather than fired from top to bottom with the lowermost gun being fired after the time delay. A more detailed description of the firing sequence is provided herein.

Figure 2:
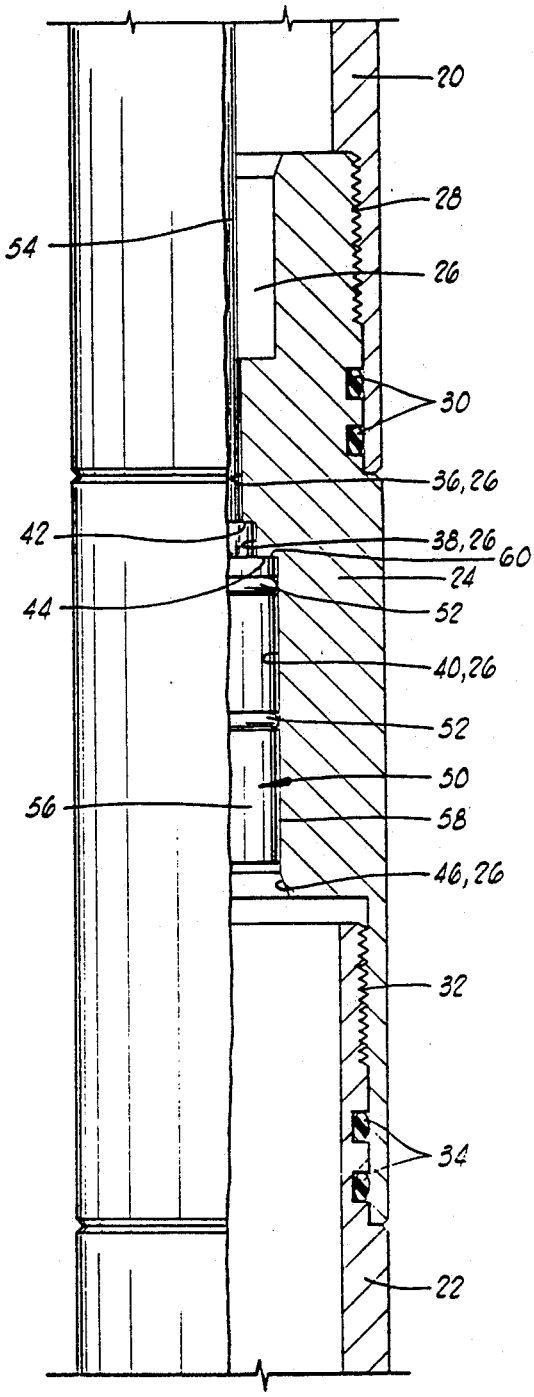
FIG. 2 is an enlarged cross-sectional detail of the portion of the tool string which holds the time delay device.

Referring now also to FIG. 2, a time delay housing means 24 is disposed between upper and lower guns 20 and 22. In the preferred embodiment, housing means 24 is characterized by an elongated housing 24 defining a longitudinal housing central opening 26 therein.

The upper end of housing 24 is connected to an upper gun 20 at threaded connection 28. Sealing means, such as O-rings 30, provide sealing engagement between the housing and lower gun.

The lower end of housing 24 is attached to lower gun 22 at threaded connection 32 with a sealing means, such as O-rings 34, therebetween.

Housing central opening 26 includes a first bore 36, a slightly larger second bore 38, and an even larger third bore 40 in housing 24. A generally annular, downwardly facing shoulder 42 extends between first and second bores 36 and 38, and another generally annular downwardly facing shoulder 44 extends between second bore 38 and third bore 40. A tapered bore 46 extends outwardly away from the lower end of third bore 40.

A time delay device 50 is positioned in central opening 26 of housing 24 and closes off the housing central opening as best shown in FIG. 2. Sealing means, such as a pair of O-rings 52, provide sealing engagement between time delay device 50 and third bore 40 of housing 24. A detonation or primer cord 54 extends downwardly from the explosive portion (not shown) of upper gun 20 and into contact with time delay device 50, as will be further discussed herein.

Figure 3:
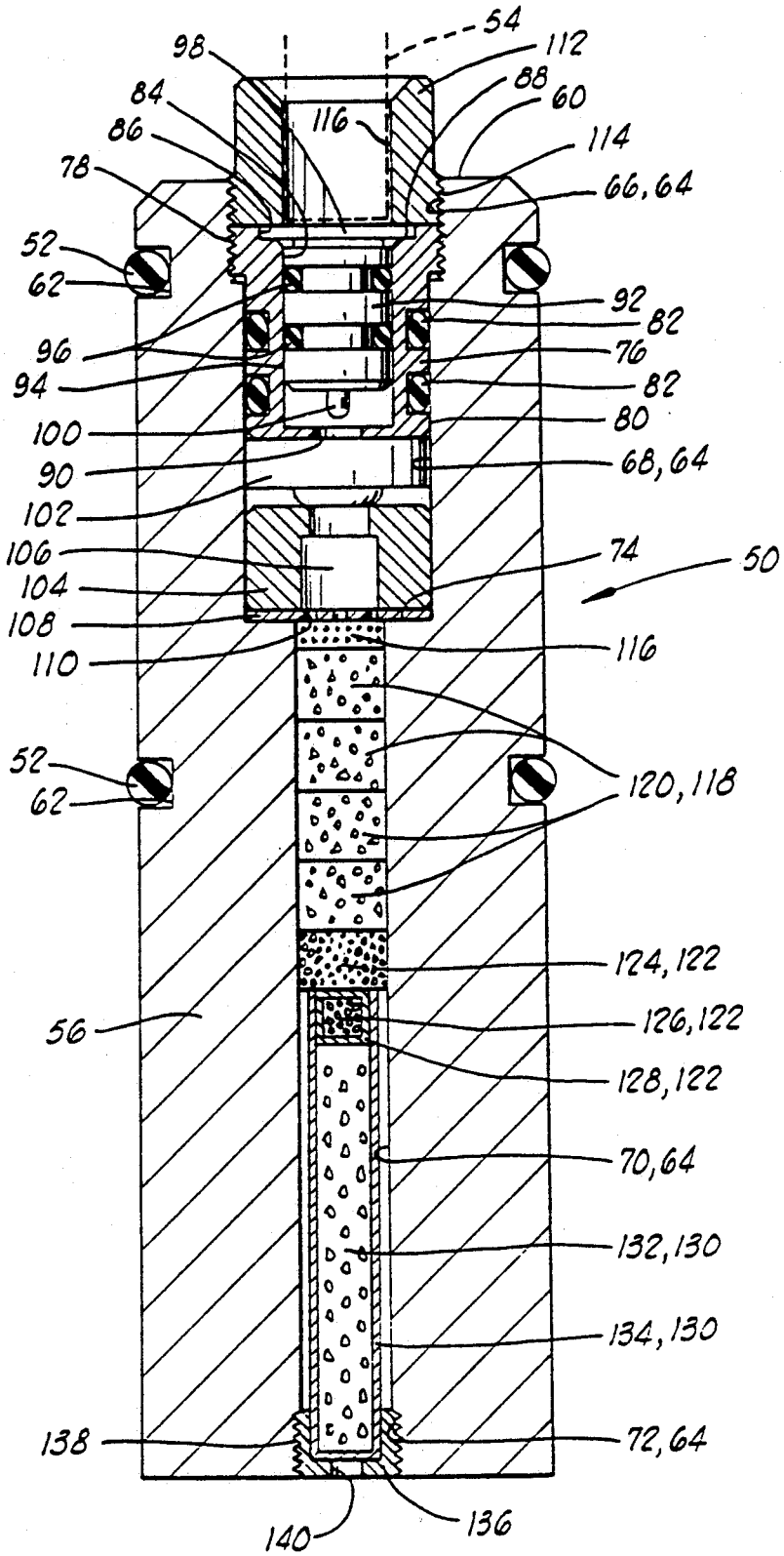
FIG. 3 is a longitudinal cross section of the time delay device.

Referring now to FIG. 3, the details of time delay device 50 are shown. Time delay device 50 includes an elongated body 56 having an outer surface 58 adapted to fit closely within third bore 40 of housing 24. An upper end 60 of body 56 is positioned adjacent to shoulder 44 in housing 24. A pair of annular grooves 62 in outer surface 58 receive O-rings 52 therein.

Body 56 defines a body central opening 64 therethrough. Body central opening 64 includes a first threaded opening 66 adjacent to upper end 60, a first bore 68, a somewhat smaller second bore 70, and a second threaded opening 72 at the lower end of second bore 70. A generally annular upwardly facing shoulder 74 extends between first and second bores 68 and 70 in body 56.

A firing pin housing 76 is disposed in the upper portion of body central opening 64 in body 56 and has a threaded portion 78 engaged with threaded opening 66 and a lower portion 80 which extends into first bore 68 in close relationship therewith. Sealing means, such as O-rings 82, provide sealing engagement between firing pin housing and first bore 68.

Firing pin housing 76 has a bore 84 therein with a counterbore 86 at an upper end thereof such that an annular, upwardly facing shoulder 88 is formed. The bottom of firing pin housing 76 has a hole 90 therethrough which is somewhat smaller than bore 84.

A firing means, such as a firing pin 92, is disposed in firing pin housing 76. A central portion 94 of firing pin 92 fits closely within bore 84. Sealing means, such as O-rings 96, provide sealing engagement between firing pin 92 and bore 84. It will thus be seen that firing pin housing 76 and firing pin 92 close off body central opening 64, and it may be generally said that the firing means closes off the body central opening.

At the upper end of firing pin 92 is a shearable flange 98 which fits in counterbore 86 and rests on shoulder 88 initially. As will be discussed in more detail herein, flange 98 will be sheared when exposed to the explosive output of gun 20 thereabove.

At the lower end of firing pin 92 is pin portion 100 which is sized to fit within hole 90 in firing pin housing 76.

Disposed below firing pin housing 76 in first bore 68 of body 56 is a primer assembly 102. Primer assembly 102 is of a kind known in the art and is adapted for detonation upon impact by pin portion 100 of firing pin 92. One such primer assembly comprises titanium potassium perchlorate ($TiKClO_4$).

A primer retainer 104 is disposed in first bore 68 of body 56 below primer assembly 102. Primer retainer 104 defines a central opening 106 therethrough.

A disc-like screen 108 having a plurality of holes 110 therein is positioned between primer retainer 104 and shoulder 74 in body 56.

Firing pin housing 76, firing pin 92, primer assembly 102, primer retainer 104 and screen 108 are clamped in the position shown in FIG. 3 by an upper retainer 112 which has a threaded portion 114 engaged with threaded opening 66 in body 56. Upper retainer 112 defines a central opening 116 therein which is adapted for receiving a lower end of detonation cord 54.

The present invention includes explosive means disposed in second bore 70 of body 56 below screen 108. The explosive means comprises several components in the preferred embodiment.

Immediately below screen 108 is an ignition mix 116, such as an AlA element.

Below ignition mix 116 is a time delay means 118, such as a time delay mix 118. A tungsten material is used in time delay mix 118 in the preferred embodiment, although the invention is not intended to be limited to tungsten. As is known in the art, the tungsten material is in powdered form, and a small portion is poured into second bore 70 of body 56 and compressed to form a tungsten increment 120. Additional tungsten increments 120 are formed in the same way so that a series of such increments are adjacent to one another in second bore 70 as seen in FIG. 3. By varying the quantity of tungsten material and the amount of compression of the powder which affects the density thereof different burn rates of time delay mix 118 are obtained.

Below time delay mix 118 is a primary explosive 122. In the preferred embodiment primary explosive 122 comprises a titanium potassium perchlorate ($TiKClO_4$) element 124 and a lead azide element 126. Lead azide element 126 is encapsulated in a small cup 128.

Below primary explosive 122 is a secondary explosive 130 which preferably comprises a PYX charge 132 in an output cup 134. Lead azide element 126 and small cup 128 are also disposed in output cup 128 but are still generally considered part of primary explosive 122 rather than secondary explosive 130.

A lower retainer 136, having a threaded portion 138 engaged with second threaded opening 76 in body 56, holds ignition mix 116, time delay mix 118, primary explosive 122 and secondary explosive 130 in place. Lower retainer 136 defines a hole 140 therein which is in communication with lower gun 22.

OPERATION OF THE INVENTION

After apparatus 10 is positioned as desired in well bore 14, upper guns 20 are triggered in any manner known in the art, and as also known in the art, sequentially fire one another. The speed of this downward sequence is typically on the order of about 8000 feet per second. This is much too fast for the operator to tell how many guns have fired.

When the lowermost one of guns 20 is fired, it ignites detonation cord 54 which provides an explosive force against the upper end of firing pin 92. This force is sufficient to shear flange 98 so that firing pin 92 is moved downwardly until pin portion 100 thereof impacts primer assembly 102. Primer assembly 102 is thus detonated and the explosive forces directed downwardly through central opening 106 in primer retainer 104 and through holes 110 in screen 108 to ignite ignition mix 116.

The heat from ignition mix 116 starts the burning of time delay mix 118. The number and density of time delay increments 120 is preselected so that a predetermined period of time is required for time delay mix 118 to completely burn, usually about 10 seconds, although any time may be selected. Once this time has passed, titanium potassium perchlorate element 124 is detonated by the burning of time delay increments 120. The output of element 124 in turn ignites lead azide element 126. Thus, in the preferred embodiment, two components of primary explosive 122 are used.

The explosion from element 126 detonates PYX charge 132 of secondary explosive 130. The explosive output of secondary explosive 130 is directed downwardly through hole 140 in lower retainer 136 and into lower gun 22. This explosive force from secondary explosive 130 then triggers lower guns 22. The actual ignition of lower guns 22 is known in the art.

Thus, the operator at the surface fires the upper guns which quickly and sequentially fire until time delay device 50 is actuated. Because of the time delay and burning of time delay elements 120 in time delay means 118, the explosive force necessary to trigger lower guns 22 is thus delayed by the predetermined amount. When lower guns 22 do fire, the significant noise and vibration resulting therefrom is observed by the operator to occur this predetermined time after the firing of upper guns 20. In this way, the operator knows that all of the guns have fired because lower guns 22 fired. If all of upper guns 20 do not fire, then time delay device 50 is never actuated, and the operator will know that the perforation operation is incomplete because the time delayed firing of lower guns 22 does not occur. As already noted, the tool can be inverted so that the firing sequence is from bottom to top rather than top to bottom. The components described herein would be the same for such an orientation except that each of those components normally would be inverted as well.

Once any of upper guns 20 are fired, fluid is free to enter the tool string through those guns. All of upper guns 20 are in fluid communication with one another, and they thus become filled with fluid. However, the time delay device 50 positioned in housing 24 blocks any fluid communication between upper guns 20 and lower guns 22. In the event of misfire of upper guns 20, lower guns 22 will not be flooded with fluid. Thus, if the tool string is retrieved, it is only necessary to replace the components above time delay device 50. The time delay device and all of the components therebelow may be reused without the necessity of disassembly with cleaning or replacement of parts. This feature of the present invention therefore provides a means of fluid isolation on long gun intervals.

Several of housings 24 with time delay devices 50 therein could be positioned along the perforating string to isolate the guns below each time delay device from the guns thereabove. Thus, in addition to the time delay benefits, this fluid isolation benefit saves considerable time in retrieving and refitting a perforating string in which there has been a misfire, and also insures the reuse of components which would otherwise have to be disassembled with some items replaced.

It will be seen, therefore, that the time delay perforating apparatus of the present invention is well adapted to carry out the ends and advantages mentioned as well as those inherent therein. While a presently preferred embodiment of the invention has been described for the purposes of this disclosure, numerous changes in the arrangement and construction of parts may be made by those skilled in the art. In particular, but not by way of limitation, different explosive compositions may be used for the various components in addition to the specific compounds cited. All such changes are encompassed within the scope and spirit of appended claims.

What is claimed is:

1. A downhole tool for perforating a well bore, said tool comprising:

first and second perforating guns; and a time delay apparatus disposed between said first and second perforating guns and comprising:

a housing attached to said first and second perforating guns and defining a housing central opening therethrough;

a body disposed in said housing central opening and defining a body central opening therethrough;

a firing pin disposed in said body central opening and adapted for firing in response to firing of said first perforating gun; and an explosive disposed in said body central opening adjacent to said firing pin and adapted for providing an explosion for firing said second perforating gun after a predetermined period of time in response to firing of said firing pin.

2. The tool of claim 1 further comprising sealing means for sealing between said time delay apparatus and said housing central opening.

3. The tool of claim 1 further comprising sealing means for sealing between said firing pin and said body central opening.

4. An apparatus for perforating a well bore and indicating when perforation is completed, said apparatus comprising:

an upper gun adapted for connecting to a tool string;

a lower gun disposed below said upper gun;

a housing interconnecting said upper and lower guns, said housing being separable from said upper and lower guns and defining a housing central opening therethrough; and a time delay device, removably disposed in said housing such that fluid communication between said upper and lower guns is prevented, for delaying firing of one of said upper and lower guns for a predetermined period of time after firing of the other of said upper and lower guns.

5. The apparatus of claim 4 wherein said time delay device comprises:

a primer assembly;

a firing pin for detonating said primer assembly;

a time delay mix;

explosive means for providing an explosion which is triggered by said time delay mix.

6. The apparatus of claim 5 wherein said explosive means is characterized by:

a primary explosive; and a secondary explosive.

7. The apparatus of claim 6 wherein said primary explosive comprises at least one of titanium potassium perchlorate and lead azide.

8. The apparatus of claim 6 wherein said secondary explosive comprises PYX.

9. The apparatus of claim 5 further comprising an ignition mix between said primer assembly and said time delay mix.

10. A time delay apparatus for use with perforating guns in a tool spring, said apparatus comprising:

a housing disposed between a pair of the perforating guns and connectable thereto, said housing defining a housing central opening therein;

a body removably disposed in said housing central opening and defining a body central opening therein;

a primer disposed in said body central opening;

firing means disposed in said body central opening for impacting said primer, said firing means being adapted for actuation by firing of one of said perforating guns;

an ignition mix disposed in said body central opening and ignitable by said primer;

an upper retainer defining a hole therethrough for partially closing an upper end of said body central opening between said primer and said ignition mix;

a time delay mix disposed in said body central opening and comprising a relatively slow burning material ignitable by said ignition mix;

a primary explosive disposed in said body central opening and ignitable by said time delay mix;

a secondary explosive disposed in said body central opening and ignitable by said primary explosive for firing the other of said pair of perforating guns; and a lower retainer disposed adjacent to said secondary explosive, said lower retainer defining a hole therein and partially closing a lower end of said body central opening.

11. The apparatus of claim 10 further comprising a screen disposed between said ignition mix and said time delay mix.

12. The apparatus of claim 10 wherein said firing means is characterized by a firing pin shearably positioned in said body.

13. The apparatus of claim 10 further comprising:

sealing means for sealing between said body and said housing central opening; and another sealing means for sealing between said firing means and said body central opening such that fluid flow through said body central opening is prevented prior to ignition.

14. The apparatus of claim 10 wherein said time delay mix comprises a tungsten time delay mix.

15. The apparatus of claim 10 wherein:

said ignition mix comprises AlA;

said primary explosive comprises at least one of titanium potassium perchlorate and lead azide; and said secondary explosive comprises PYX.

* * * * *